US008344832B2

(12) United States Patent
Lee

(10) Patent No.: US 8,344,832 B2
(45) Date of Patent: Jan. 1, 2013

(54) MAGNETIC SWITCH

(75) Inventor: Sang Jin Lee, Daegu (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 0 days.

(21) Appl. No.: 13/272,119

(22) Filed: Oct. 12, 2011

(65) Prior Publication Data

US 2012/0092094 A1 Apr. 19, 2012

(30) Foreign Application Priority Data

Oct. 15, 2010 (KR) ..... 10-2010-0100784

(51) Int. Cl.
*H01H 67/02* (2006.01)

(52) U.S. Cl. ..... 335/126; 335/131

(58) Field of Classification Search ..... 335/126, 335/131, 132

See application file for complete search history.

(56) References Cited

U.S. PATENT DOCUMENTS 5,546,061 A * 8/1996 Okabayashi et al. ..... 335/78
6,229,416 B1 * 5/2001 Ebihara et al. ..... 335/131
6,486,762 B2 * 11/2002 Kurasawa et al. ..... 335/278

FOREIGN PATENT DOCUMENTS

EP 0798752 10/1997
EP 1953784 8/2008

* cited by examiner

*Primary Examiner* — Elvin G Enad
*Assistant Examiner* — Lisa Homza
(74) *Attorney, Agent, or Firm* — Lee, Hong, Degerman, Kang & Waimey

(57) ABSTRACT

A magnetic switch comprises a first frame and a second frame, a stationary contact to face the second frame, a movable contact contactable with or separated from the stationary contact, a coil assembly that generates a magnetic force in accordance with a flow of an electric current, a movable unit that makes the movable contact to be contactable with or separated from the stationary contact, a contact spring that applies an elastic force to the movable contact in a direction that the movable contact moves toward the stationary contact, a movable distance limiting unit limiting a movable distance of the movable unit to determine a contact pressure distance that the movable contact contacts the stationary contact and the contact spring is pressed, and a return spring to apply an elastic force to the movable unit in a direction that the movable contact is separated from the stationary contact.

3 Claims, 4 Drawing Sheets

MAGNETIC SWITCH

CROSS-REFERENCE TO RELATED APPLICATION

This application claims the benefit of earlier filing date and right of priority to Korean Application No. 10-2010-0100784, filed on Oct. 15, 2010, the contents of which is incorporated by reference herein in its entirety.

BACKGROUND OF THE INVENTION

1. Field of the Invention

This specification relates to a magnetic switch capable of controlling power supply with being employed in an electric vehicle or the like.

2. Background of the Invention

In general, a magnetic switch is installed between a battery and an electric power converter(inverter) in electric vehicles or the like, such as hybrid vehicles, fuel cell vehicles, electric golf carts and electric folk lifts, for supplying or break the electric power supply from the battery to the electric power converter.

The magnetic switch comprises a movable contact contactable with or separated from a stationary contact, and an electromagnetic actuator to actuate the movable contact. The related art electromagnetic actuator comprises a coil, a stationary core, a movable core, a shaft, a return spring and a contact spring.

One of important factors which determine the performance of the magnetic switch is a contact pressure distance of a movable contact connected to the movable core and movable to a closing position contacting a corresponding stationary contact connected to the stationary core or an opening position separating from the stationary contact. The contact pressure distance corresponds to a value obtained by subtracting a contact distance between the stationary contact and the movable contact on the opening position from a movable distance of the movable core. However, in the related art magnetic switch, the contact pressure distance may be affected directly by the deviation of the movable distance or the contact distance. For example, with the same contact distance, if the movable distance increases by 0.1 mm due to a defective welding of a shaft of the movable core, the contact pressure distance further increases by 0.1 mm. Similarly, with the same movable distance, if the contact distance decreases by 0.1 mm because the stationary contact is installed 0.1 mm closer to the movable contact, the contact pressure distance further increases by 0.1 mm.

In general, the movable distance of the movable contact is within 2 mm, and in this case, the contact pressure distance should be controlled within 0.1 mm. However, as aforementioned, in the related art magnetic switch, when the deviation of the movable distance or the contact distance is generated due to an assembly tolerance of the movable core, the shaft and the stationary contact, it may immediately affect the contact pressure distance, which results in the deviation over the performance of the magnetic switch.

SUMMARY OF THE INVENTION

Therefore, to address those problems of the related art, an aspect of the detailed description is to provide a magnetic switch capable of minimizing factors affecting a contact pressure distance and accordingly minimizing the deviation over the performance of the magnetic switch.

To achieve these and other advantages and in accordance with the purpose of this specification, as embodied and broadly described herein, a magnetic switch comprises a first frame, a second frame coupled to the first frame, a stationary contact installed at the first frame to face the second frame, a movable contact contactable with or separated from the stationary contact, a coil assembly installed at the second frame to face the first frame and having a coil to generate a magnetic force in accordance with a flow of an electric current on the coil, a movable unit to make the movable contact to be contactable with or separated from the stationary contact during reciprocating through the central portion of the coil assembly, the movable unit comprising a shaft to movably support the movable contact in an axial direction and a core coupled to the periphery of the shaft to be movable together with the shaft, a contact spring to apply an elastic force to the movable contact in a direction that the movable contact moves toward the stationary contact, a movable distance limiting unit formed at the first frame, the movable distance limiting unit limiting a movable distance of the movable unit to determine a contact pressure distance within which the movable contact contacts and is pressed by the stationary contact, and a return spring to apply an elastic force to the movable unit in a direction that the movable contact is separated from the stationary contact.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are comprised to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings.

Figure 1:
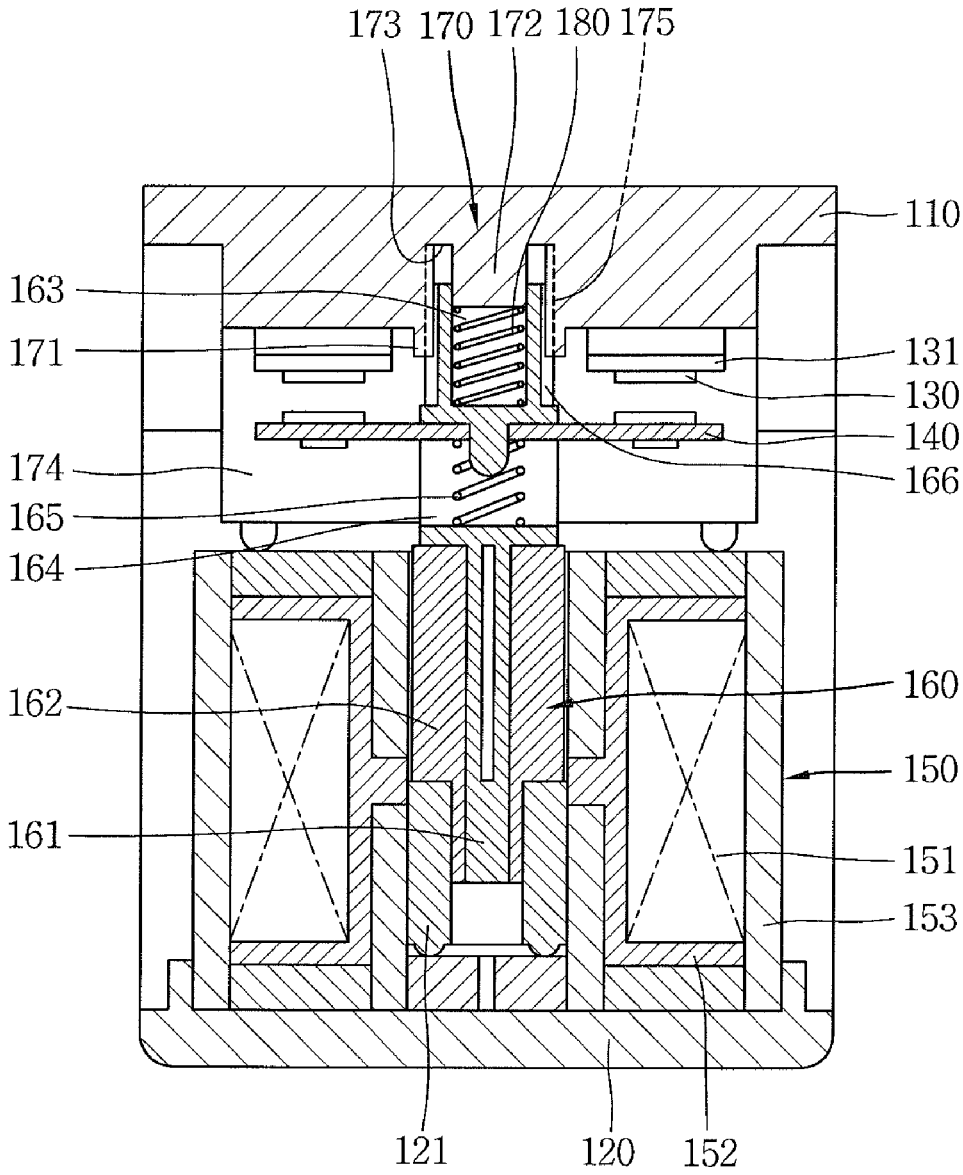
FIG. 1 is a front sectional view of a magnetic switch in accordance with a preferred embodiment of the present invention.
Figure 2:
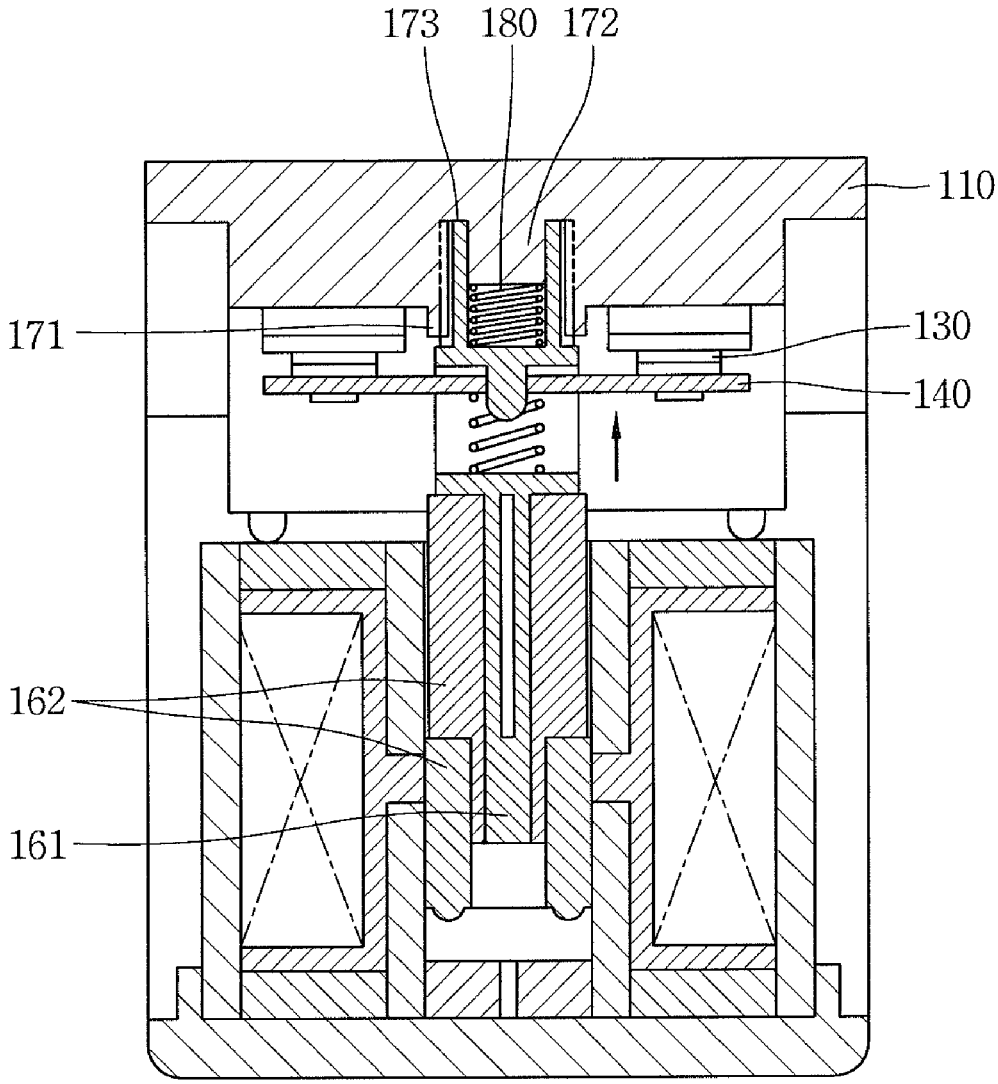
FIG. 2 is a sectional view showing a magnetic switch shown in FIG. 1 that a movable unit has moved such that a movable contact comes in contact with a stationary contact.
Figure 3:
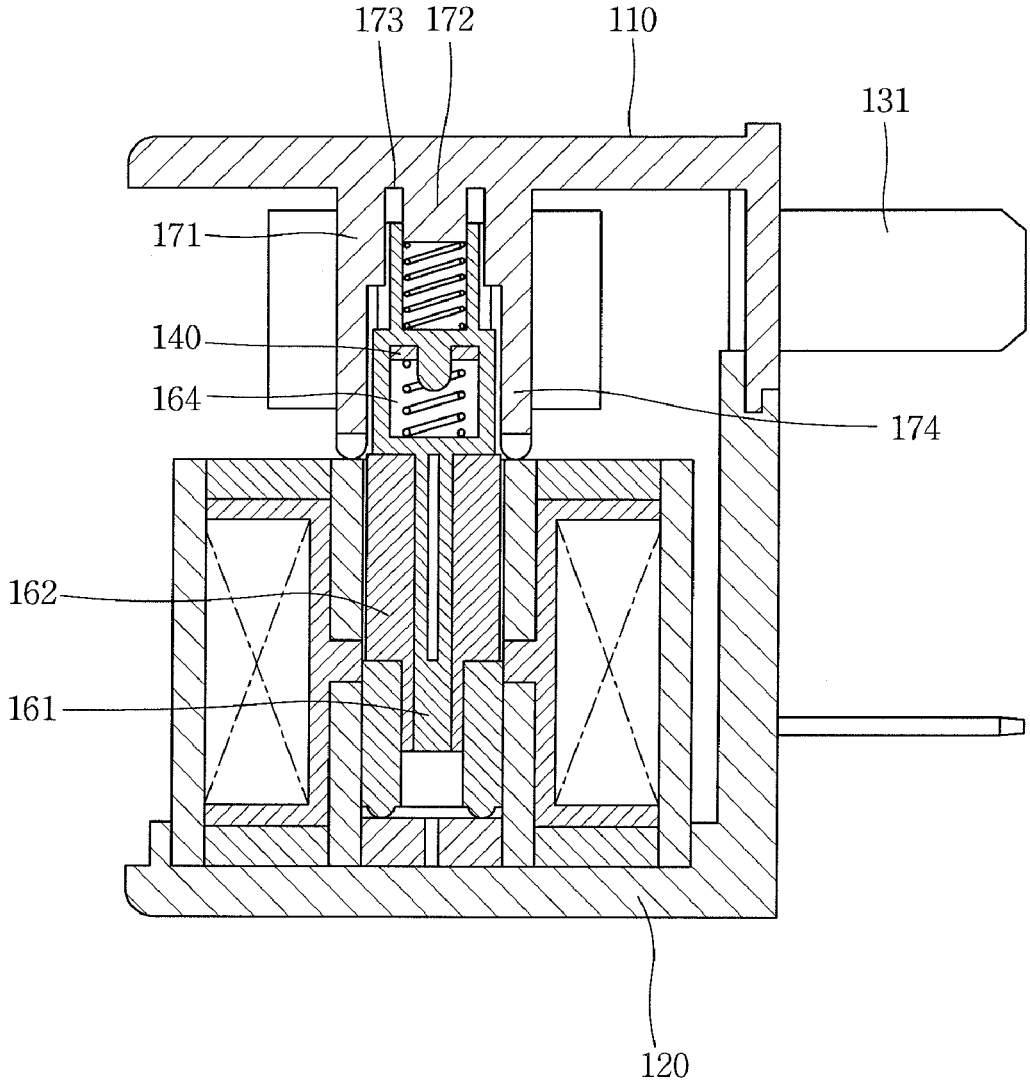
FIG. 3 is a side sectional view of the magnetic switch shown in FIG. 2.
Figure 4:
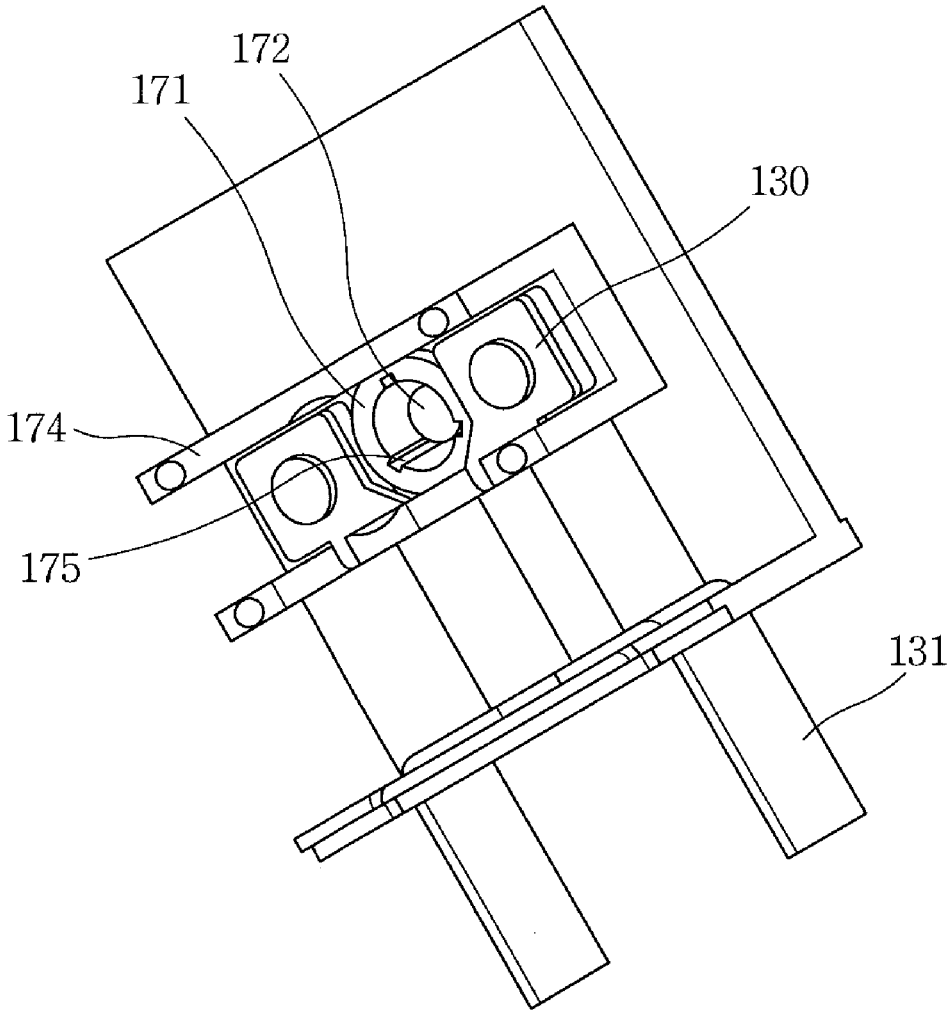
FIG. 4 is a perspective view of a first frame and the stationary contact shown in FIG. 1.

As shown in FIGS. 1 to 4, a magnetic switch comprises a first frame 110, a second frame 120, a stationary contact 130, a movable contact 140, a coil assembly 150, a movable unit 160, a contact spring 165, a movable distance limiting unit 170, and a return spring 180.

The stationary contact 130 may be supported by being installed at the first frame 110. The coil assembly 150 may be supported by being installed at the second frame 120. The first frame 110 and the second frame 120 may be coupled to each other with the stationary contact 130 and the coil assembly 150 facing each other. Here, at least one side of each of the first frame 110 and the second frame 120 may extend and such extended portions may be coupled to each other such that the first frame 110 and the second frame 120 can be spaced from each other with a predetermined space therebetween.

The stationary contact 130 may be installed at the first frame 110 to face the second frame 120. The stationary contact 130 may be connected to a fixed terminal 131. The fixed terminal 131 may be connected to the stationary contact 130 at one end thereof, and secured at the first frame 110 with being externally protruded through the first frame 110. The stationary contact 130 may be provided in plurality.

The movable contact 140 may be contactable with or separated from the stationary contact 130. When the plurality of stationary contacts 130 are provided, the corresponding number of movable contacts 140 may be provided as well and all aligned to face the stationary contacts 130, respectively. The movable contact 140 may be supported by the movable unit 160.

The coil assembly 150 may be installed at the second frame 120 to face the first frame 110. The coil assembly 150 has a coil 151 which generates a magnetic force in accordance with a flow of an electric current on the coil 151. The coil 151 may be wound around a bobbin 152 and received within a housing 153. The housing 153 may be fixed on the second frame 120 and supported by the second frame 120.

The movable unit 160 may make the movable contact 140 to be contactable with or separated from the stationary contact 130 while reciprocating through the central portion of the coil assembly 150. The movable unit 160 comprises a shaft 161 that supports the movable contact 140 to be movable in an axial direction, and a core 162 coupled to a periphery of the shaft 161 to be movable together with the shaft 161.

When an electric current is supplied to the coil 151, the core 162 moves together with the shaft 161, by a magnetic force generated around the coil 151, so as to bring the movable contact 140 into contact with the stationary contact 130. When the current supplied to the coil 151 is broken, the core 162 moves together with the shaft 161, by an elastic force of the return spring 180, so as to make the movable contact 140 to be separated from the stationary contact 130. The movable unit 160 may be supported by a support member 121 installed at the second frame 120.

The contact spring 165 applies an elastic force to the movable contact 140 to be moved toward the stationary contact 130. Accordingly, when the movable contact 140 comes in contact with the stationary contact 130, the movable contact 140 may be kept contacting the stationary contact 130, by virtue of contact pressure generated by an elastic force of the contact spring 165. The contact spring 165 may be configured as a compression coil spring, and installed to elastically support the rear end of the movable contact 140.

The movable distance limiting unit 170 may be formed at the first frame 110 to limit the movable distance of the movable unit 160. The movable distance limiting unit 170 may limit the movable distance of the movable unit 160 so as to determine a contact pressure distance that the movable contact 140 contacts the stationary contact 130 and the contact spring 165 is pressed. The contact pressure distance of the movable contact 140 may correspond to a value obtained by subtracting the contact distance between the stationary contact 130 and the movable contact 140 from the movable distance of the movable unit 160. Hence, under the condition that the contact distance value is the same, the contact pressure distance may be determined according to the movable distance value limited by the movable distance limiting unit 170.

When an electric current is supplied to the coil 151, the core 162 is moved together with the shaft 161 to bring the movable contact 140 into contact with the stationary contact 130. Here, the contact distance between the stationary contact 130 and the movable contact 140 is shorter than the movable distance of the movable unit 160. Accordingly, the movable contact 140 may be brought into contact with the stationary contact 130 before the shaft 161 reaches a top position of FIG. 2 from a bottom position of FIG. 1. Further continuous moving up to the top position of the shaft 162, after the contact of the movable contact 140 with the stationary contact 130, compress the contact spring 165 between the stopped movable contact 140 and the shaft 162 moving up to the top position. The movable contact 140 may be kept contacting the stationary contact 130 by virtue of contact pressure generated in response to the compression of the contact spring 164.

The return spring 180 may apply an elastic force to the movable unit 160 in a direction to separate the movable contact 140 from the stationary contact 130.

Accordingly, in a state that the movable unit 160 has moved by the magnetic force generated responsive to the current supply such that the movable contact 140 contacts the stationary contact 130, when the current supplied to the coil 151 is broken, the movable unit 160 moves back to its original position by the elastic force of the return spring 180. Consequently, the movable contact 140 can be separated from the stationary contact 130. The return spring 180 may be configured as a compression coil spring.

With the configuration of the magnetic switch, both the stationary contact 130 and the movable distance limiting unit 170 are located at the first frame 110, accordingly, the contact distance between the stationary contact 130 and the movable contact 140 changes cooperative with the movable distance limited by the movable distance limiting unit 170, whereby the contact pressure distance of the movable contact 140 can be uniformly maintained.

For example, when the first frame 110 is lowered in height by 0.1 mm due to an assembly tolerance, the movable distance of the movable unit 160 formed at the first frame 110 is reduced by 0.1 mm. However, since the stationary contact 130 is also located with being coupled to the first frame 110, the contact distance between the stationary contact 130 and the movable contact 140 is cooperatively reduced by 0.1 mm. As such, since the movable distance and the contact distance change by the same value, no change may occur in the contact pressure distance which is a value obtained by subtracting the contact distance from the movable distance. Hence, the factor affecting the contact pressure distance can be reduced, as compared with the related art, and thusly the deviation over the performance of the magnetic switch can be minimized.

In the meantime, the movable distance limiting unit 170 may comprise a guide portion 171 and a protrusion 172. The guide portion 171 may comprise an accommodation groove 173 to accommodate one end portion of the movable unit 160. An inner wall of the accommodation groove 173 may contact an outer wall of the shaft 161 so as to guide sliding of the shaft 161. The protrusion 172 may protrude toward the movable unit 160 from a bottom surface of the accommodation groove 173.

The shaft 161 may comprise a spring support groove 163. The spring support groove 163 may guide an entry of the protrusion 172. The return spring 180 may be accommodated between the spring support groove 163 and the protrusion 172. Accordingly, when the shaft 161 moves to bring the movable contact 140 into contact with the stationary contact 130, the end portion of the shaft 161 may come in contact with the bottom surface of the accommodation groove 173.

The end of the guide portion 171 may extend from the first frame 110 as long as being supported by contacting the coil assembly 150. The guide portion 171 may further comprise a movable contact guide 174 to accommodate the movable contact 140 therein so as to guide movement of the movable contact 140.

The shaft 161 may be provided with a movable contact hole 164. The movable contact hole 164 may guide the movable contact 140, which is inserted therethrough, to be movable in the axial direction of the shaft 161. The contact spring 165 may be located within the movable contact hole 164.

An anti-rotation protrusion 166 may be formed at a periphery of the shaft 161, and an anti-rotation recess 175 may be formed in the accommodation groove 173. The anti-rotation protrusion 166 may extend in the axial direction of the shaft 161 and protrude in the radial direction of the shaft 161. The anti-rotation protrusion 166 may be inserted in the anti-rotation recess 175 and guided thereby such that the shaft 161 can move in the axial direction of the shaft 161 with the rotation of the movable contact 140 prevented. The anti-rotation protrusion 166 may be provided in plurality. The anti-rotation recess 175 may be provided as the same as the number of anti-rotation protrusions 166.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A magnetic switch comprising:

a first frame;

a second frame coupled to the first frame;

a stationary contact installed at the first frame to face the second frame;

a movable contact configured to make contact with or be separated from the stationary contact;

a coil assembly installed at the second frame to face the first frame and having a coil configured to generate a magnetic force according to a flow of an electric current through the coil;

a movable unit configured to cause the movable contact make contact with or be separated from the stationary contact while reciprocating through a central portion of the coil assembly, the movable unit comprising a shaft configured to movably support the movable contact in an axial direction and a core coupled to a periphery of the shaft such that the core is movable together with the shaft;

a contact spring configured to apply an elastic force to the movable contact in a direction that the movable contact moves toward the stationary contact;

a movable distance limiting unit formed at the first frame, the movable distance limiting unit configured to limit a movable distance of the movable unit in order to determine a contact pressure distance for the movable contact to make contact with the stationary contact when the contact spring is pressed; and a return spring configured to apply an elastic force to the movable unit in a direction that the movable contact is separated from the stationary contact, wherein the movable distance limiting unit comprises a guide portion having an accommodation groove configured to accommodate one end portion of the movable unit;

wherein a protrusion protrudes from a bottom surface of the accommodation groove toward the movable unit, wherein the shaft comprises a spring support groove configured to guide entry of the protrusion, and wherein the return spring is located between the spring support groove and the protrusion.

2. The switch of claim 1, wherein:

the shaft further comprises a movable contact hole configured to guide the movable contact through the movable contact hole such that the movable contact is movable in the axial direction of the shaft; and the contact spring is installed in the movable contact hole.

3. The switch of claim 2, wherein:

an anti-rotation protrusion protrudes from the periphery of the shaft and extends in the axial direction of the shaft;

an anti-rotation recess is formed in the accommodation groove; and the anti-rotation protrusion is inserted in the anti-rotation recess in order to be guided such that the shaft is movable while rotation of the movable contact is prevented.

* * * * *